United States Patent [19]

Carew

[11] Patent Number: 4,911,066

[45] Date of Patent: Mar. 27, 1990

[54] FITTED VENTILATION LOUVER

[76] Inventor: Dean F. S. Carew, c/o Alvac Limited, 182 Wellington Street, Bowmanville, Ont., Canada

[21] Appl. No.: 182,992

[22] Filed: Apr. 18, 1988

[51] Int. Cl.[4] ..... F24F 7/00

[52] U.S. Cl. ..... 98/121.1; 52/473; 98/29

[58] Field of Search ..... 98/29, 121.1; 52/198, 52/473

[56] References Cited

U.S. PATENT DOCUMENTS

| | | | |
|---|---|---|---|
| 1,633,032 | 6/1927 | Hordling | 98/29 X |
| 2,530,919 | 11/1950 | Taylor | 98/29 |
| 2,565,555 | 8/1951 | Goldberg | 98/121.1 X |
| 2,752,844 | 7/1956 | Simblest | 98/121.1 |
| 3,302,554 | 2/1967 | Rovsey et al. | 98/121.1 |
| 3,584,427 | 6/1971 | Johnston | 52/473 |

FOREIGN PATENT DOCUMENTS

| | | | |
|---|---|---|---|
| 1454511 | 11/1976 | United Kingdom | 98/121.1 |

*Primary Examiner*—Harold Joyce
*Attorney, Agent, or Firm*—David J. French

[57] ABSTRACT

A ventilation louver is provided with a contoured flange to provide an intimate fit against a textured exterior wall surface. A plunging groove formed in the louver provides a means for attaching the louver to the interior wall support structure, while allowing the louver and flange to protrude and fit outside exterior sliding on the wall.

3 Claims, 3 Drawing Sheets

FITTED VENTILATION LOUVER

FIELD OF THE INVENTION

This invention relates to a louvre for installation on the side of a building to allow ventilation, and for decoration, and for a method of making the same. More particularly, this invention relates to a ventilation louvre that is adapted to be installed in an improved manner within an opening cut through the exterior surfacing of a covered wall.

BACKGROUND TO THE INVENTION

In the construction field it is customary to install ventilation openings in walls to allow the passage of air and limit the accumulation of condensation. The opening, once formed, is generally filled by a slatted or otherwise weather-protected fitting, called herein a "ventilation louvre", or "louvre".

The function of a louvre is to permit the passage of air, while deflecting rain that might otherwise enter through the opening in the wall. Often louvres are installed on exterior walls that are faced with clapboard or siding. On occasion, they are installed in brick faced walls. In all such cases it is desirable, for aesthetic purposes, that the louvre should screen or cover the edges of the opening cut in the wall. The edges of the louvre should also be sealed against the exterior facing of the wall to prevent the entry of rain running down the exterior surface into the opening cut in the wall. This latter requirement is generally met by applying caulking between the outer border of the louvre, and the covering on the side of the building.

It has been customary in the past to install a louvre on the framing for a wall prior to the application of the final covering. To effect the attachment of prior art louvres to the framing, such louvres have been equipped with flanges that extend beyond the diameter of the body of the louvre. When brick or siding is then applied to the wall, and cut so as to abut the body of the louvre, the louvre essentially becomes "locked-in". The flanges prevent its removal without removing a portion of the brick or siding.

An alternate construction procedure entails completing the entire covering of the wall, in brick or siding, before installing the louvre. A hole is then cut for the installation of the louvre. In such a case it is not possible, without opening a hole of excessive width, to install a louvre that has outwardly extending flanges which attach the louvre to the interior framing. It is possible to attach the louvre to the exterior covering, and this has been done in the past. But it would be preferable to provide for a louvre that could be installed in an opening after a wall is covered, and still be attached to the interior studding or supports of the building.

As mentioned previously, it is desirable to seal the outer boundary of the louvre against the exterior wall surface to prevent the entry of water around its edges. A flat circular exterior ring or flange may be applied around the outside boundary of the body of the louvre to screen the edges of the wall covering and close-over gaps between that covering and the body of the louvre. When the wall surface is perfectly smooth the residual gaps between the flange and wall surface in such a case are small, and may easily be sealed with caulk. Thus on a non-textured or non-contoured exterior wall surface, the procedure for sealing the exterior of a louvre is relatively simple.

Where an exterior wall is textured or contoured, however, as in the case of clapboard, aluminum or plastic siding, or even brick-work where the bricking style leaves an uneven surface, considerable gaps and cracks may exist. These gaps may not so easily be filled with caulk if they are particularly large.

An improved means of ensuring an intimate fit between the outside of a louvre and adjacent textured or contoured wall surface would therefore be desirable. Further, it would be desirable to provide a louvre with an improved means by which it may be attached to the structural supports of a wall with such a contoured surface, after the exterior covering has been installed.

These and other benefits are accommodated by the invention which is hereafter described.

SUMMARY OF THE INVENTION

According to the invention a louvre is provided with an outside flange which is adapted to conform to the shape of a predetermined building covering against which it is to be placed. By a further feature of the invention the flange may terminate in a skirting wall that is adapted to conform to the shape of the exterior wall surface.

According to the invention, in another aspect, a louvre, adapted for installation over a wall covering that has been previously applied to an interior wall support structure, is provided with a central body, a bordering exterior flange adapted to cover a portion of said wall covering, and a plunging surface segment that lies between the body and the flange, said plunging segment being adapted to extend from the louvre to the wall support structure so as to stand the louvre off from such structure returning thereafter outwardly to said flange, and thereby providing means by which said louvre may be attached to said support structure walls, at the same time, supporting said flange.

By a further feature of the invention a method of making a flanged louvre adapted to fit intimately against the contour of a textured surface of a wall bordering said louvre is provided by the steps of:

(1) selecting a sample of the textured wall with a louvre-accepting opening cut therein, (2) preparing a first mold portion that conforms positively to the shape of the textured wall around the border of the louvre opening, (3) installing within said first mold portion a further mold adapted to form the shape of the body of a louvre within a combined mold, (4) utilizing the combined mold, molding an integrally flanged louvre having a contour-conforming outer flange which is adapted to fit intimately against the contour of said textured wall.

These and further features of the invention will be better appreciated by reference to the description of the preferred embodiment which follows hereafter.

DESCRIPTION OF THE PREFERRED EMBODIMENTS

Figure 1:
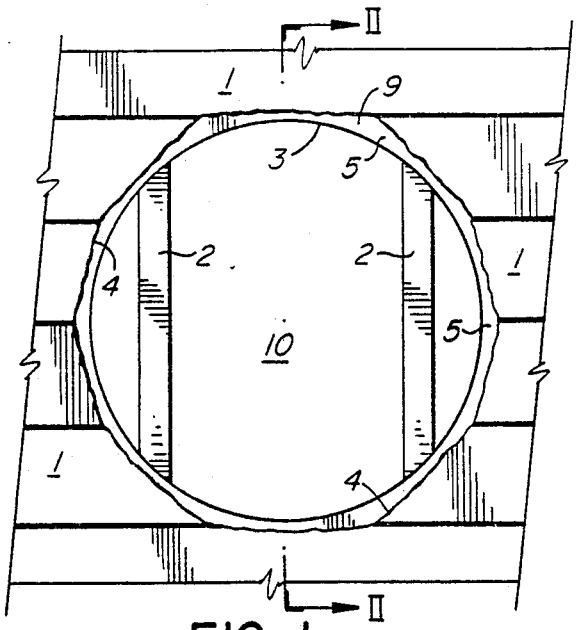
FIG. 1 is front view of an opening in a stud-supported wall covered with siding.

In FIG. 1 a series of siding pieces 1 are depicted as fastened to a wall having an interior support structure formed by studs 2 and plywood sheathing 9. Shown in outline 3 is the edge of a hole 10 cut in the sheathing 9 to provide a space that will be occupied by a louvre, once installed.

The ends 4 of the siding have been roughly cut to terminate at the edge of the outline 3. Because it is convenient to cut the ends 4 with a saw, these ends 4 are typically straight. This leaves enlarged gaps 5 around the border of the outline 3.

Figure 2:
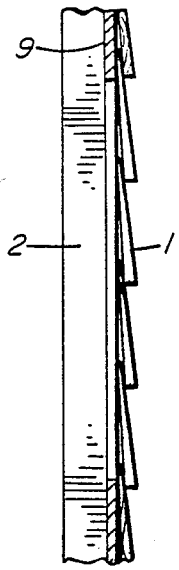
FIG. 2 is an edge view of the side of the opening of FIG. 1.

In FIG. 2 an edge view from within the opening 10 of the siding shows the textured or contoured profile that is typical of siding 1. The siding shown in FIG. 2 is depicted as having a straight wedge shaped outline in profile. In fact modern aluminum siding is often curved and has additional ridges.

Figure 3:
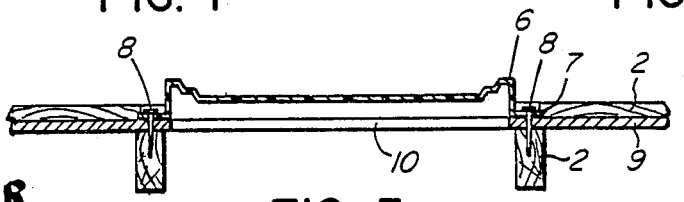
PRIOR ART FIG. 3
FIG. 3 is a cross-sectional profile of a prior art form of louvre which is fastened to studs and is then overlaid by siding.
Figure 4:
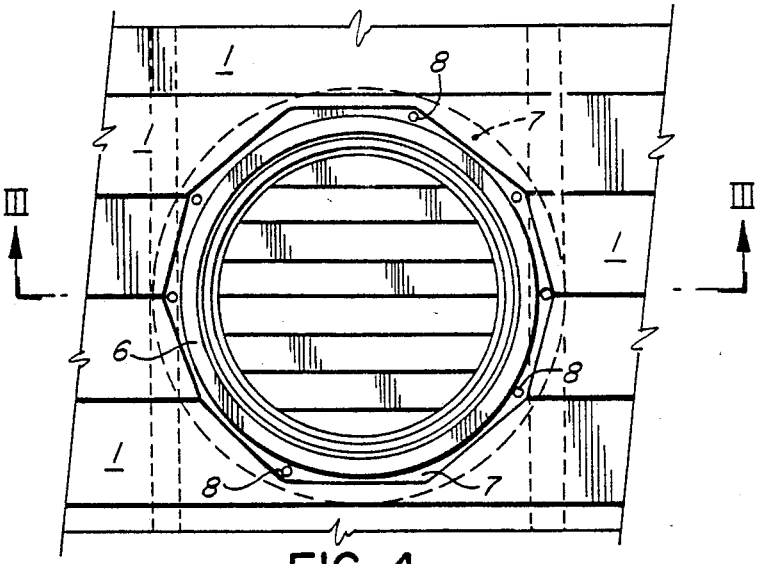
PRIOR ART FIG. 4
FIG. 4 is a front view of the louvre of FIG. 3.

In FIGS. 3 and 4 a typical prior art louvre 6 is shown in edge outline and front view respectively. This louvre 6 has a flange 7 that may be fastened by nails through holes 8 to the studs 2 or plywood sheathing 9. The siding 1 is then laid over the flange 7 to encase the louvre 6. The plywood sheathing 9 is shown as an exterior covering over the studs 2. This sheathing 9, which is typically incorporated over a studded frame for structural integrity is, however, an optional feature for the support structure of a wall. When present, this sheathing 9 is cut away beneath the louvre 6 to produce the opening 10.

The studs 2 in FIGS. 3 and 4 are shown placed at the extremity of the louvre 6 to show the fastening detail at the flange 7 more clearly in FIG. 3. In fact, the studs 2 may be placed within the opening 10, as depicted in FIG. 1. In such case it is typical in the prior art, though not essential to fasten the louvre 6 through the sheathing 9 at holes 8 that coincide with the studs 2. The Louvre may be attached to the sheathing 9, but it is preferrable that it may be anchored to the studs 2.

The foregoing constituted a description of the prior art. A louvre with a combined bordering flange 16 and a plunging groove 13 according to the invention is shown in edge view in FIG. 5. In this view the body 11 of the louvre 6 spans from one side to the other, terminating in an encircling perpendicular wall 12. This perpendicular wall defines one side of a plunging groove 13 which has a bottom portion 14 and an outer wall portion 15. The louvre 6 terminates in an exterior encircling flange 16. The bottom portion 14 may be provided with a hole to receive screws or nails 8 for attaching the louvre to a building support member, such as a stud 2 or to the sheathing 9. Alternately, such holes may be made at the time of installation. The depth of the plunging groove 13 is sufficient to allow the louvre 6 to be mounted outwardly of the siding 2 with the exterior flange 16 in close proximity to the outer surface of the siding 2.

The flange 16 generally will entirely encircle the louvre 6 providing a cover or screen for the ends 4 of the siding 2, this obscuring the view of rough-cut ends.

Figure 5:
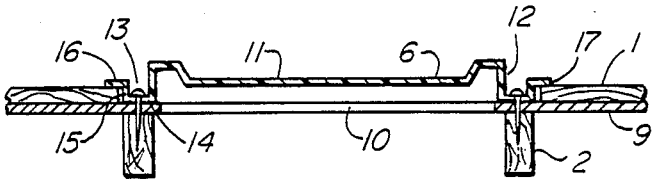
FIG. 5 is a cross-sectional profile of a louvre provided with a plunging stand-off groove and according to the invention.

The plunging groove 13 as shown in FIG. 5 may optionally encircle the louvre 6. Alternately, it may be intermittently formed around the outer boarder of the louvre 6. The function of the plunging groove is to form a stand-off element which will allow the louvre 6 to be attached directly to the supporting structure of the wall, e.g. the studs 2, while allowing the louvre 6 to extend sufficiently outwardly besides the protruding siding 1. The flange 16 both screens the jagged edges of the siding 1 around the opening 10, and provides an edge 17 along which caulking (not shown) may be applied. The advantages of such a plunging groove is that it enables the louvre to be installed in a hole in the wall cut after the siding is applied. It also may be formed integrally with the louvre.

The foregoing description is equally applicable to a louvre to be installed against a smooth or a contoured exterior surface. If the flange 16 is flat, it will fit intimately against a smooth exterior surface. If the exterior surface is composed of contoured siding 1, then a flat encircling flange 16 will expose gaps between itself and the siding which must be filled with caulking.

Figure 10:
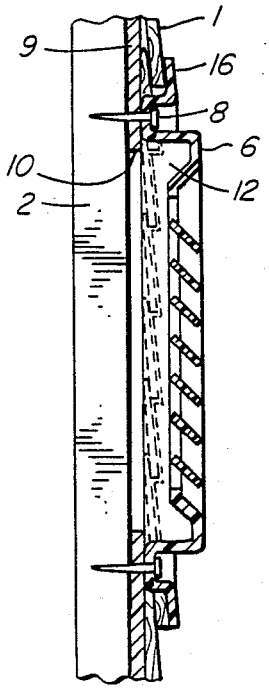
FIG. 10 is a vertical cross-sectional view through FIG. 9.
Figure 11:
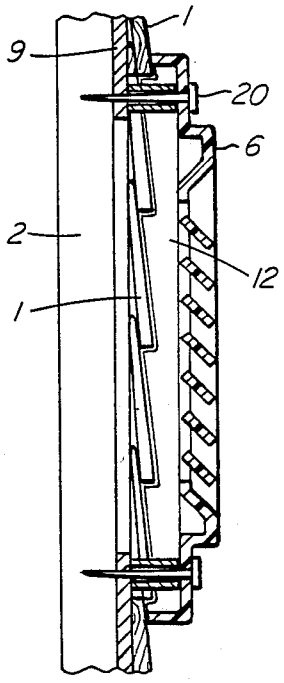
FIG. 11 is a vertical cross-section through a louvre mounted in accordance with FIG. 7.

By way of another feature of the invention, the exterior flange 16 of a ventilation louvre may be contoured to fit the profile of specifically preselected textured siding 1, with contours which intersect with the borders of the hole 10. An example of such a louvre is shown in FIG. 10 where the flange 16 is shown to be contoured to fit closely with the siding 1. The use of a contoured flange may be adapted to either mode of attaching the louvre to the building wall. FIG. 11 shows such an intimate contoured interfit in the case of an attachment means for the louvre, as in FIG. 7. The object of preparing a flange of such a character will be to provide a more intimate fit between the flange and the siding. This, in turn, will provide a more weather-tight seal once the louvre is caulked. A louvre with a contoured flange may be prepared by making a mold that has a bordering edge that corresponds to the contour that the siding 2 will present around the opening 10 into which the louvre 6 is to be installed. Generally, louvres of the type described are conveniently made by vacuum-form molding. While this molding technique is not essential, it has proved convenient.

By whatever molding technique that is to be adopted, the mold for forming the body 11 of the louvre 6 may be fitted within a mold for forming the flange 16 that conforms to the shape of the siding 2 into which the louvre 6 is to be installed. A louvre 6 produced from such a composite mold can then be formed with an exterior flange 16 that will follow the contour of the siding 2. This will eliminate gaps between the flange 16 and the siding 2 and ensure a better seal when caulking is applied along the edge 17 of the flange 16. The advantage of the vacuum forming process is that a louvre with an exterior contoured flange and a plunging groove may be manufactured conveniently, in a single operation, from a flat sheet of plastic stock.

By the procedure as described, the flange 6, when formed from a flat sheet contoured by vacuum molding, will not present a flat surface to a person viewing the louvre 6 from face-on. If it is desired to preserve the appearance of a flat encircling flange this effect may be achieved without departing from the invention by thickening the upper surface of the flange 16 and forming a flat top thereon. Such a process may, however, require a molding technique such as injection molding. Another alternative may be provided by adopting the configuration shown in FIG. 6.

Figure 6:
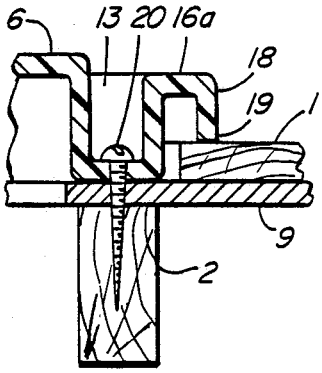
FIG. 6 is an enlarged profile view of a louvre incorporating a profiled skirting wall.

FIG. 6 is an enlarged view of a cross-section through the perimeter of a louvre 6 having a plunging groove 13. In this case, the encircling flange **16*a* has been elevated, by means of an elongation of the height of the outer wall 15, at a distance above the siding 2. To close the gap between the elevated flange 16*a* and the siding 2, a curtain wall or skirting wall 18 descends from the flange 16*a* to the siding 1. By applying the molding method previously described, the lower edge 19 of the curtain wall 18 can be formed so that it follows the contour of the preselected siding 1. This provides an integral fit for efficient caulking. It also provides an aesthetically acceptable flat surface for the encircling flange 16*a* while accommodating, in particular, the vacuum forming process. A further advantage of this type of configuration is that the height of the flange 16*a*** becomes freely variable, in accordance with the aesthetic requirements of the louvre design.

The above description has demonstrated the application of the invention, in its various features, to a fully round louvre. It is equally applicable to square, rectangular, hexagonal, semi-circular and other shapes of louvres.

The concept of a contoured encircling flange has been described in association with the feature of a plunging stand-off groove. These features need not necessarily both be present. Either feature may be utilized apart from the other to useful effect.

A louvre incorporating a contoured encircling flange may be mounted without resort to a plunging groove by the substitution of other stand-off means for the groove. Such an arrangement is shown in FIG. 7.

Figure 7:
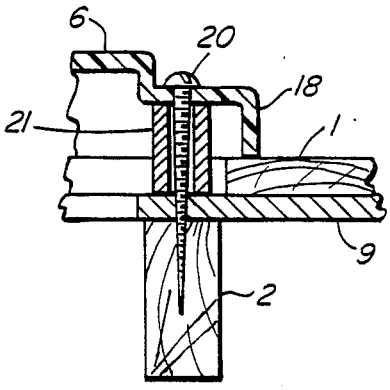
FIG. 7 is an enlarged cross-sectional view of an alternate support for a louvre with a profiled outer flange.

FIG. 7 shows the enlarged detail in cross-section of a louvre 6 having a contoured encircling skirt 18. The louvre 6 is fastened by screws or screw nails 20 to the stud 2. A cylindrical sleeve 21 is mounted around the screw 20 to provide a stand-off support for the louvre 6. Thus by selecting the correct length of sleeve 21, louvre 6 is capable of being installed at the correct position to allow the edge 19 of the skirt 18 to lie closely against the siding 2.

Figure 8:
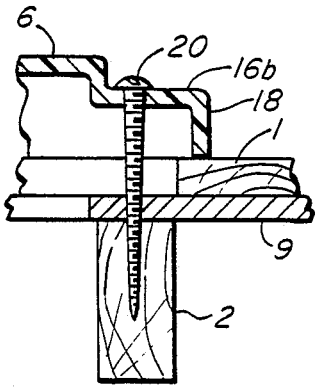
FIG. 8 is an enlarged cross-sectional view of an alternate support for a louvre with a profiled outer flange.

By way of a further alternative, the louvre 6 may be fastened by screws 20 to the studs 2 without the presence of the stand off cylinder 21. This is shown in FIG. 8. In this arrangement the screws 20 are tightened until the skirting wall 18 contacts the siding and holds the louvre in position. This embodiment, while capable of holding the louvre 6 in place, is less desirable as it places a clamping stress on the plastic walls, e.g. the skirting wall 18, of the louvre 6 and the flange **16*b***.

Figure 9:
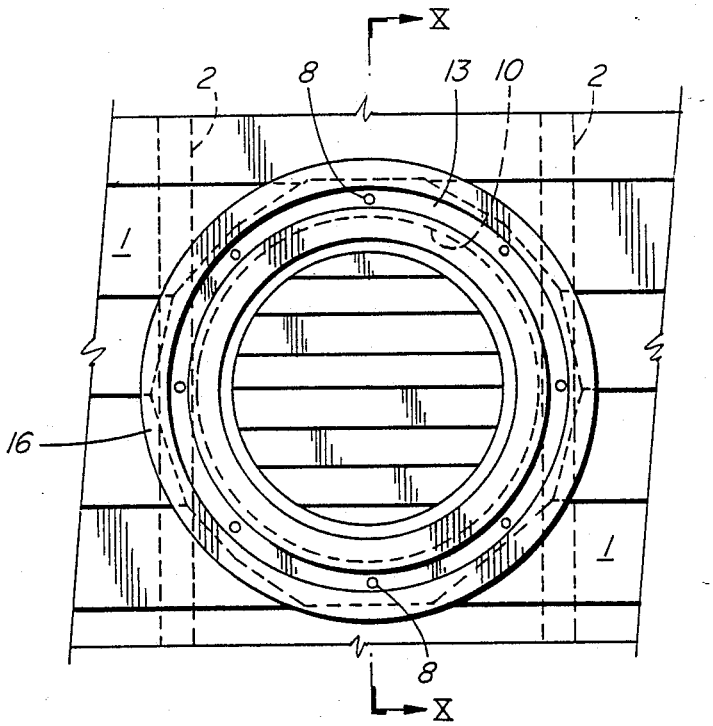
FIG. 9 is a front view of a louvre as in FIG. 5, installed in an opening in a wall of siding.

A depiction in front view of a louvre 6 according to the invention and corresponding to any of the configurations of FIGS. 5 through 8 is shown in FIG. 9. In this view it will be seen that the encircling flange 16 conveniently covers the ends of the siding 2, thus screening them from view. While the contour-fitting character of the flange 16 in FIG. 9 is not directly apparent from the drawing, it will be understood that the flange 16, or the bordering skirt 18, are so contoured in accordance with the invention.

The foregoing constitutes a description of various embodiments of the invention in order to serve as examples. The invention in its broadest and more particular aspects is further described and defined in the claims which now follow.

I claim:

1. A method of making a flanged louvre adapted to fit intimately against the contour of a textured surface of a wall bordering said louvre is provided by the steps of:

(1) selecting a sample of the textured wall with a louvre-accepting opening cut therein, (2) preparing a first mold portion that conforms positively to the shape of the textured wall around the border of the louvre opening, (3) installing within said first mold portion a further mold adapted to form the shape of the body of a louvre within a combined mold, (4) utilizing the combined mold, molding an integrally flanged louvre having a contour-conforming outer flange which is adapted to fit intimately against the contour of said textured wall.

2. A louvre for installation within or over a hole formed in a wall which has a contoured exterior surface, the contours of which intersect with the borders of said hole, said louvre having a body portion and an integrally formed flange portion, wherein said flange portion is adapted for installation over said exterior wall surface and is shaped by transverse contours so as to fit closely, in a contoured manner, against the boundaries of the surface surrounding the said hole.

3. A louvre as in claim 2 in which said flange terminates along its outer edge in a skirting wall that is angled towards said wall and is contoured at its terminating edge to fit against the contoured exterior surface of said wall.

* * * * *